US012332012B2

(12) United States Patent
Chesus

(10) Patent No.: US 12,332,012 B2
(45) Date of Patent: Jun. 17, 2025

(54) GAS-OPERATED FIREARM

(71) Applicant: ANCILLA Industries LLC, San Marcos, CA (US)

(72) Inventor: Tyler Wayne Chesus, San Marcos, CA (US)

(73) Assignee: ANCILLA INDUSTRIES LLC, San Marcos, CA (US)

( * ) Notice: Subject to any disclaimer, the term of this patent is extended or adjusted under 35 U.S.C. 154(b) by 69 days.

(21) Appl. No.: 18/197,936

(22) Filed: May 16, 2023

(65) Prior Publication Data

US 2024/0053115 A1 Feb. 15, 2024

Related U.S. Application Data

(60) Provisional application No. 63/397,084, filed on Aug. 11, 2022.

(51) Int. Cl.
*F41A 5/24* (2006.01)

(52) U.S. Cl.
CPC ..... *F41A 5/24* (2013.01)

(58) Field of Classification Search
CPC ..... F41A 5/24
See application file for complete search history.

(56) References Cited

U.S. PATENT DOCUMENTS 2,865,256 A * 12/1958 Marsh ..... F41A 3/62 89/191.01
5,959,234 A * 9/1999 Scaramucci ..... F41A 5/22 89/193
6,619,592 B2 * 9/2003 Vignaroli ..... F41A 5/18 89/193
8,065,949 B1 * 11/2011 Molinari ..... F41A 5/28 89/193
8,210,089 B2 7/2012 Brown
9,046,312 B2 * 6/2015 Dieckmann ..... F41A 5/26
9,134,082 B2 9/2015 Brown
9,939,228 B2 * 4/2018 Cheng ..... F41C 23/16
11,493,292 B2 * 11/2022 Gomez ..... F41A 3/64
11,519,681 B2 * 12/2022 Kennedy ..... F41A 5/26
11,578,932 B2 * 2/2023 Sugg ..... F41A 3/66
11,994,357 B2 * 5/2024 Salinas ..... F41A 5/28
2011/0271826 A1 * 11/2011 Molinari ..... F41A 5/28 89/193

(Continued)

*Primary Examiner* — Michelle Clement

(74) *Attorney, Agent, or Firm* — Bennet K. Langlotz; Langlotz Patent & Trademark Works, LLC

(57) ABSTRACT

A gas-operated firearm has a frame, a barrel defining a bore having a forward muzzle end and an opposed rear end defining a chamber, a bolt assembly received in the frame and operable to reciprocate between a battery position and a recoil position, the barrel defining a gas aperture communicating with the bore, a gas operating system connected to the frame, having a gas inlet, and operably connected to the bolt assembly to move the bolt assembly from the battery position toward the recoil position, and the gas inlet being forward of the gas aperture. There may be a gas conduit extending forward from the gas aperture to the gas inlet. The gas aperture may be proximate the rear end of the barrel. Unlike conventional gas-operated firearms, the barrel is free of contact with any other elements except proximate the rear end of the barrel.

18 Claims, 4 Drawing Sheets

(56) References Cited

U.S. PATENT DOCUMENTS

| | | | | |
|---|---|---|---|---|
| 2013/0025445 | A1* | 1/2013 | Windauer | F41A 5/28 89/193 |
| 2015/0241149 | A1* | 8/2015 | Mcmillen, IV | F41A 5/28 89/193 |
| 2022/0333884 | A1* | 10/2022 | Kennedy | F41A 5/26 |
| 2023/0122319 | A1* | 4/2023 | Fleiner | F41A 5/28 89/193 |
| 2023/0125921 | A1* | 4/2023 | Keeney | F41A 5/28 89/193 |
| 2023/0228507 | A1* | 7/2023 | Fisher | F41A 5/26 89/193 |
| 2024/0230260 | A1* | 7/2024 | Sims | F41A 5/28 |
| 2024/0247893 | A1* | 7/2024 | Williams | F41A 3/66 |
| 2024/0288237 | A1* | 8/2024 | Gangl | F41A 5/28 |

* cited by examiner

GAS-OPERATED FIREARM

CROSS-REFERENCE TO RELATED APPLICATION

This application claims the benefit of U.S. Provisional Patent Application No. 63/397,084 filed on Aug. 11, 2022, entitled "PRECISION GAS SYSTEM (PGS)," which is hereby incorporated by reference in its entirety for all that is taught and disclosed therein.

FIELD OF THE INVENTION

The present invention relates to firearms, and more particularly to a gas-operated firearm that has a free-floating barrel with bolt action accuracy despite being gas operated.

BACKGROUND AND SUMMARY OF THE INVENTION

There are two major types of firearm systems: manual bolt action and gas operated. Many bolt action firearms are more accurate than gas-operated firearms. Gas-operated firearms have faster repeatability, but less accuracy. Bolt action firearms feature a free-floating barrel. This means there are no parts touching the barrel, so the barrel harmonics are not disrupted while the bullet travels down the barrel when the bolt action firearm is fired.

In gas-operated firearms, where gas resulting from each shot extracts and loads the next round, a complex gas management system requires more moving parts and more contact with the barrel. This results in disruption of the barrel harmonics, reducing accuracy. While there have been many improvements to gas management systems over time to reduce the barrel harmonic disruption, there continues to be disruption from parts contacting the barrel that reduces accuracy. This reduced accuracy is partially created by gas block system contact with the barrel.

Therefore, a need exists for a new and improved gas-operated firearm that has a free-floating barrel with bolt action accuracy despite being gas operated. In this regard, the various embodiments of the present invention substantially fulfill at least some of these needs. In this respect, the gas-operated firearm according to the present invention substantially departs from the conventional concepts and designs of the prior art, and in doing so provides an apparatus primarily developed for the purpose of having a free-floating barrel with bolt action accuracy despite being gas operated.

The present invention provides an improved gas-operated firearm, and overcomes the above-mentioned disadvantages and drawbacks of the prior art. As such, the general purpose of the present invention, which will be described subsequently in greater detail, is to provide an improved gas-operated firearm that has all the advantages of the prior art mentioned above.

To attain this, the preferred embodiment of the present invention essentially comprises a frame, a barrel defining a bore having a forward muzzle end and an opposed rear end defining a chamber, a bolt assembly received in the frame and operable to reciprocate between a battery position and a recoil position, the barrel defining a gas aperture communicating with the bore, a gas operating system connected to the frame, having a gas inlet, and operably connected to the bolt assembly to move the bolt assembly from the battery position toward the recoil position, and the gas inlet being forward of the gas aperture. There may be a gas conduit extending forward from the gas aperture to the gas inlet. The gas aperture may be proximate to the rear end of the barrel. The gas aperture may be closer to the rear end of the barrel than to the forward end of the barrel. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
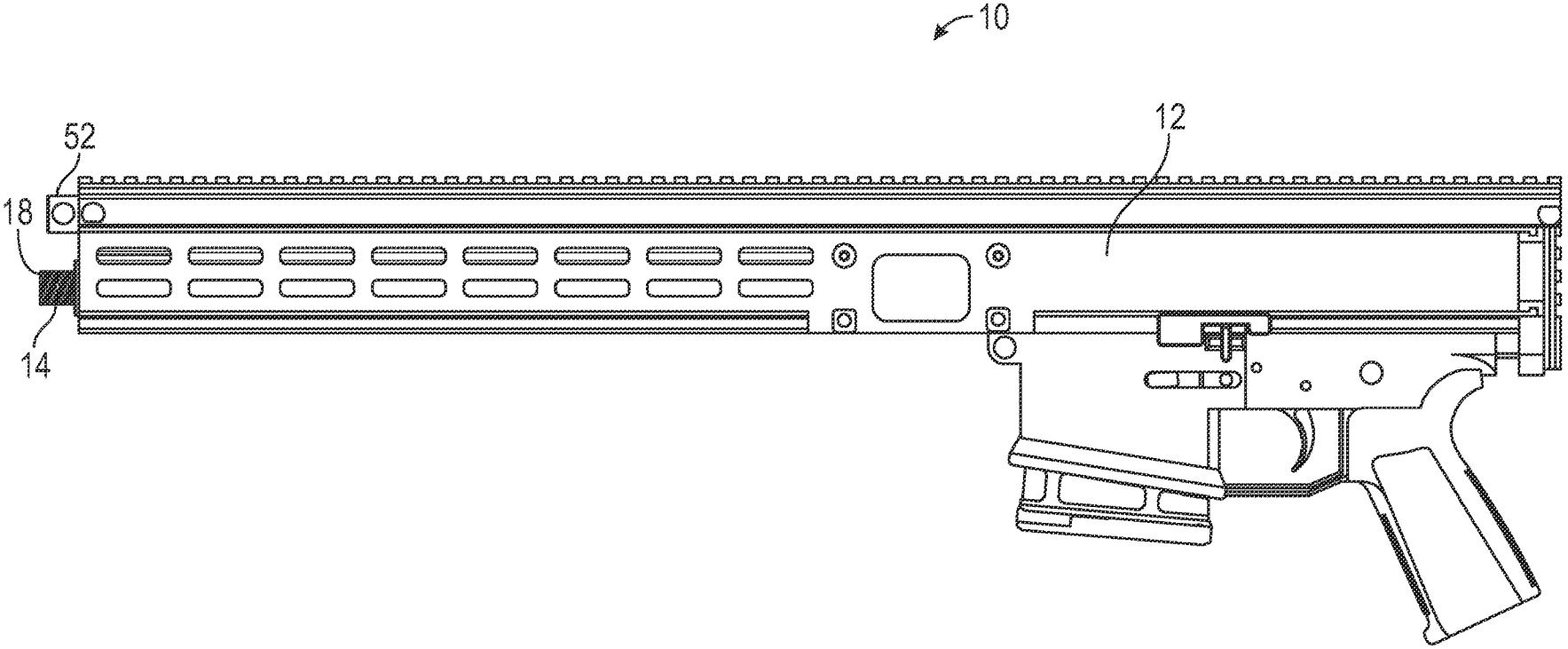
FIG. 1 is a top perspective view of the current embodiment of a gas-operated firearm constructed in accordance with the principles of the present invention.
Figure 2:
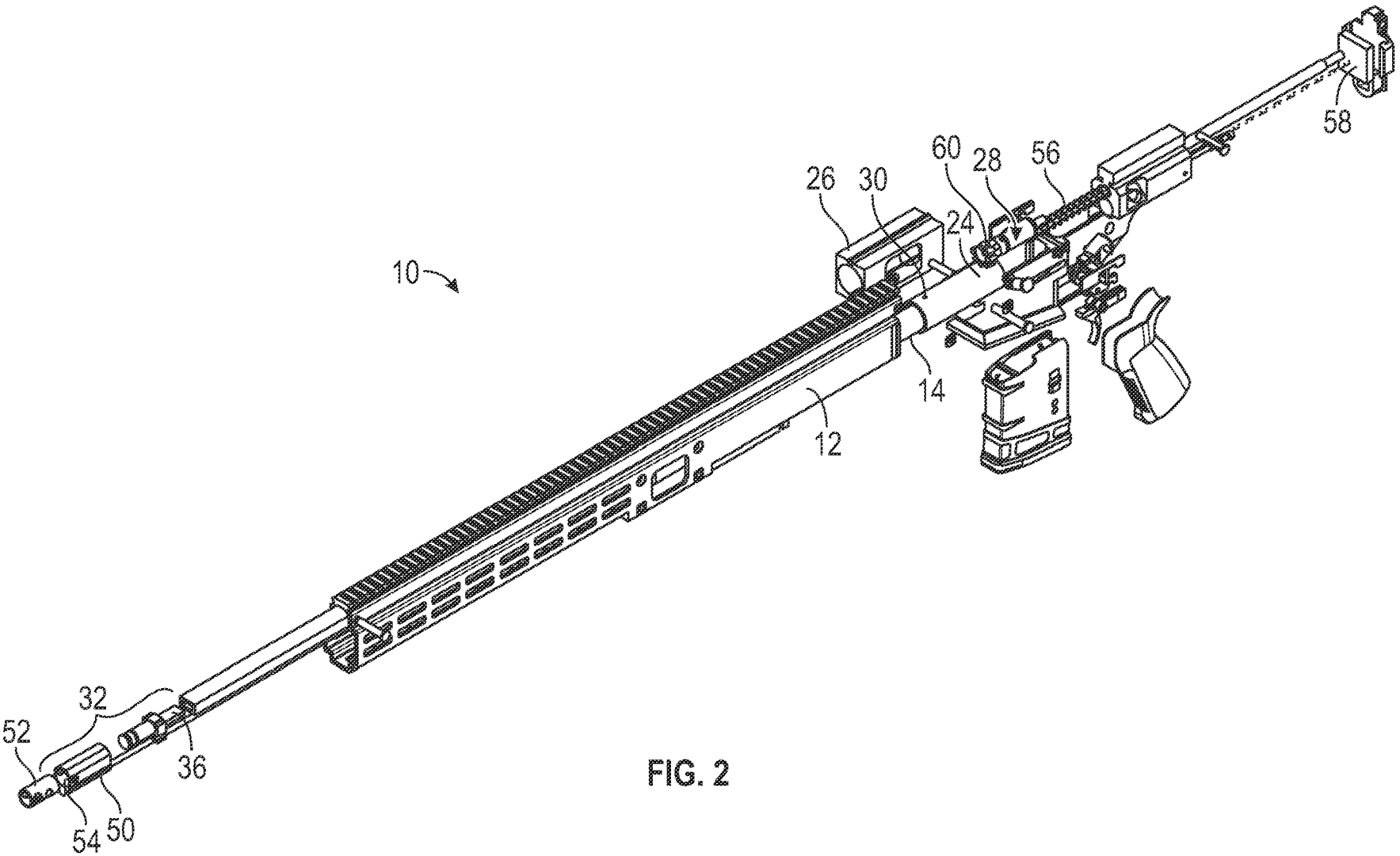
FIG. 2 is an exploded view of the gas-operated firearm of FIG. 1.

An embodiment of the gas-operated firearm of the present invention is shown and generally designated by the reference numeral 10.

Figure 3:
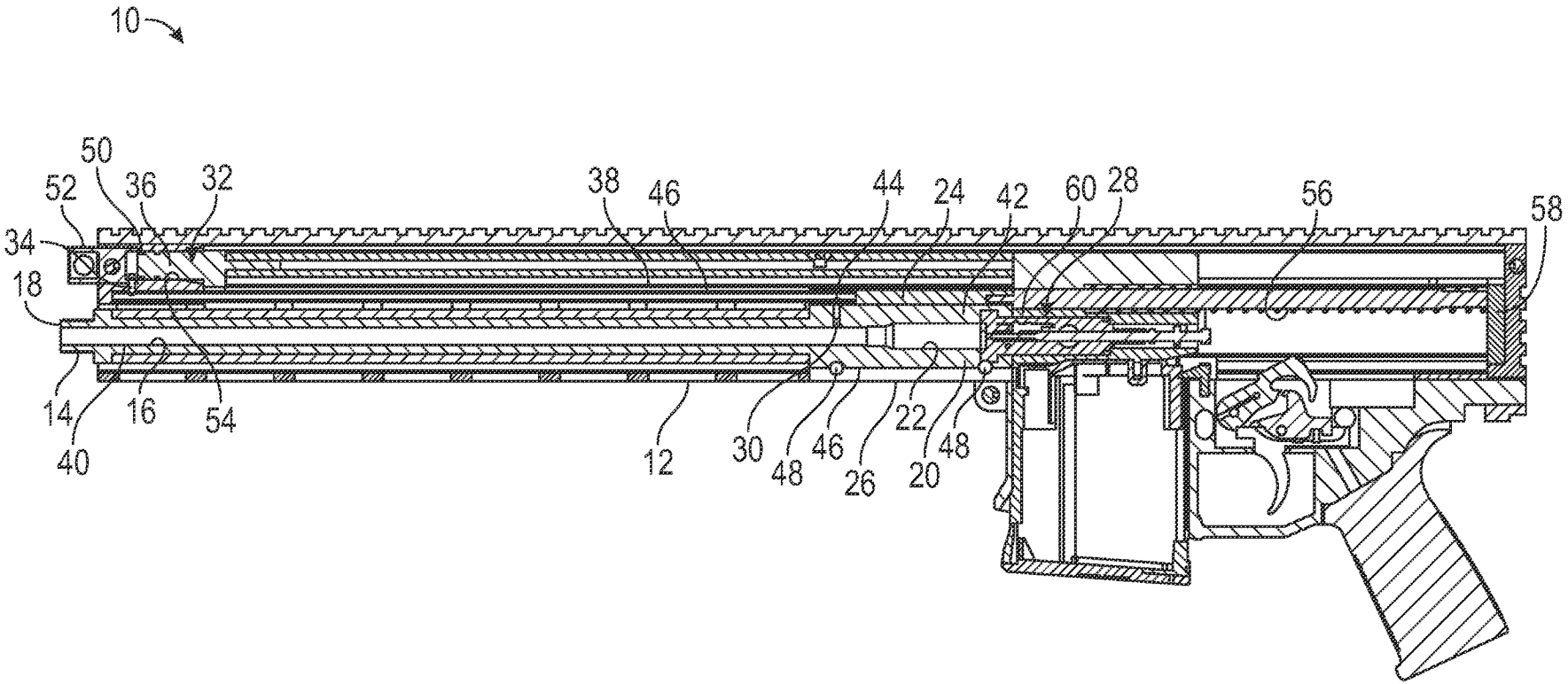
FIG. 3 is a side sectional view of the gas-operated firearm of FIG. 1 in the battery position.
Figure 4:
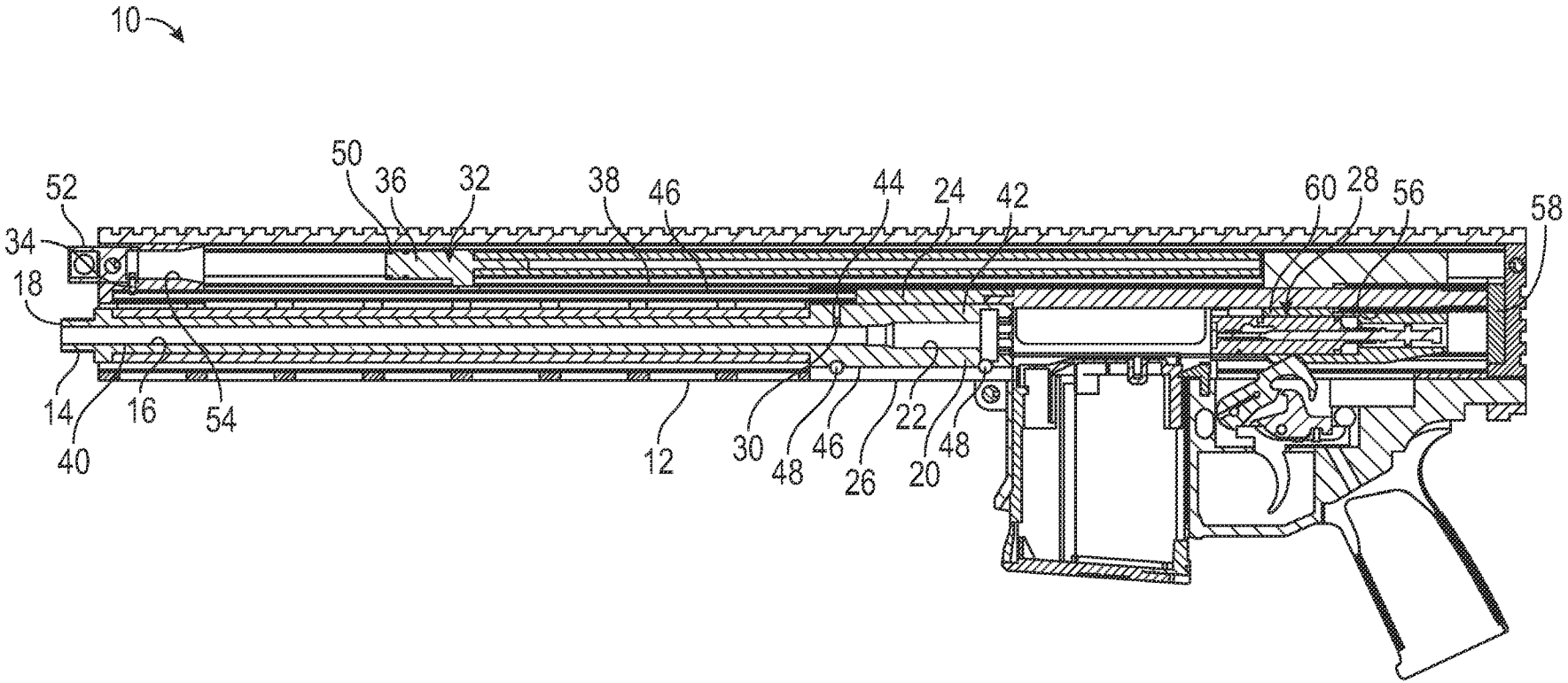
FIG. 4 is a side sectional view of the gas-operated firearm of FIG. 1 in the recoil position.

FIGS. 1-4 illustrate the improved gas-operated firearm 10 of the present invention. More particularly, FIG. 3 shows the gas-operated firearm in the battery position, and FIG. 4 shows the gas-operated firearm in the recoil position. The gas-operated firearm has a frame/chassis 12. This frame is used in the general sense of a structure that may include an upper receiver, lower receiver, chassis, stock, and any number of structural elements, and does not intend to convey the meanings of terms like "frame" such as may be used for firearms regulations. A barrel 14 defines a bore 16 having a forward muzzle end 18 and an opposed rear end 20 that defines a chamber 22. The barrel includes a barrel extension 24 threaded onto the barrel that is received by a barrel mount 26 that is part of the frame. The barrel mount serves as an attachment facility securing a rear portion 42 of the barrel to the frame. A bolt assembly 28 is received in the frame and operable to reciprocate between a battery position and a recoil position. The barrel defines a gas aperture 30 proximate the attachment facility and in communication with the bore. A gas operating system 32 is connected to the frame. The gas operating system has a gas inlet 34, includes a piston 36, and is operably connected to the bolt assembly to move the bolt assembly from the battery position toward the recoil position. The piston and the bolt assembly can be made of metal, polymer, or composite materials. In the current embodiment, the piston is threadedly connected to the bolt assembly. A gas conduit 38 defined by the frame extends forward from the gas aperture to the gas inlet. In the current embodiment, the gas inlet is forward of the gas aperture. The gas aperture is closer to the rear end of the barrel than to the forward muzzle end of the barrel and is preferably proximate to the rear end of the barrel.

Unlike conventional gas-operated firearms, the barrel 14 is free of contact with any other elements except proximate the rear end 20 of the barrel. A forward portion 40 of the barrel is free of contact with any other element except proximate the rear end of the barrel. The forward portion is the majority of the length of the barrel. The gas aperture 30 is rearward of the forward portion of the barrel and is defined in the rear portion 42 of the barrel. The gas operating system is free of contact with the barrel. The frame 12 contacts the barrel only at the rear portion of the barrel. The rear portion of the barrel has a cylindrical profile, and the gas aperture is defined in the rear cylindrical profile portion. The barrel can have a variety of diameters along its length, with the rear portion being the largest diameter portion of the barrel.

The barrel mount 26 is a clamping system that seals around the rear portion 42 of the barrel and seals the gas aperture 30 to a barrel mount orifice 44 to reduce gas escape. The barrel mount serves as a gas receiver to direct the flow of gas from the gas aperture to the barrel mount orifice. The barrel mount also provides a rigid, high-strength system that increases the accuracy of the gas-operated firearm 10 by firmly securing the rear portion of the barrel to the frame. The barrel mount orifice is in communication with the gas conduit 38. The gas conduit receives a gas tube 46 open at both ends that is in communication with the barrel mount orifice and gas inlet 34 to enable gas to travel from the bore 16 through the gas aperture to the gas operating system via the gas inlet.

The barrel 14 and barrel extension 24 can be made of metal, polymer, or composite materials. The gas aperture 30 is located immediately in front of the chamber 22. The forward muzzle end 18 of the barrel is threaded, enabling the use of various attachments such as flash hiders and suppressors with the gas-operated firearm 10. The bottom 46 of the barrel defines two bolt slots 48 that enable the barrel to be mounted to the frame 12. The location of the bolt slots also ensures the gas aperture is aligned with the barrel mount orifice 44 when the barrel is installed in the frame.

The gas operating system 32 includes a piston block 50 attached to the frame 12. The piston block can be made of metal, polymer, or composite materials and is a unitary part. The piston block holds a piston a gas key 52 and receives one end of the gas tube 46. The piston gas key regulates the flow of gas into the piston block, defining a pressure chamber 54 and a stable guide for the piston 36. In the current embodiment, there are three orifices on the piston gas key for regulating pressure. These orifices are aligned so that gas passes through them, traveling from the front to the rear.

The bolt assembly 28 interacts with a spring recoil system 56 and a recoil plate 58. The spring recoil system in recoil plate can be made of metal, polymer, or composite materials. The recoil plate stabilizes the spring recoil system and is integrated into the frame 12. The spring recoil system is compressed against the recoil plate by the bolt assembly when the piston 36 is urged rearwardly by gas entering the pressure chamber 54 until the bolt assembly reaches the recoil position. Once the gas pressure has sufficiently reduced, the spring recoil system pushes the bolt assembly and piston forward to return the bolt assembly to the battery condition. The bolt assembly includes a bolt 60. The bolt is operable to extract a discharged cartridge from the chamber 22 during recoil after the gas-operated firearm 10 has been fired and to load an unfired cartridge from a magazine into the chamber as the bolt assembly returns to the battery position.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a gas-operated firearm has been described in detail, it should be apparent that modifications and variations thereto are possible, all of which fall within the true spirit and scope of the invention. Although rifles have been disclosed, the gas-operated firearm is also suitable for use with shotguns, light and medium machine guns, and other firearms. It should also be appreciated that the gas-operated firearm can operate without a piston if an additional gas tube is attached from the piston block to the bolt assembly. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture;

including a gas conduit extending forward from the aperture to the gas inlet, the gas conduit serially intervening between the gas aperture and the gas inlet.

2. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture; and wherein the gas aperture is proximate the rear end of the barrel.

3. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture; and wherein the gas aperture is closer to the rear end of the barrel than to the forward end of the barrel.

4. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture; and wherein the barrel is free of contact with any other element except proximate the rear end of the barrel.

5. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture; and wherein a forward majority of the length of the barrel is free of contact with any other element except proximate the rear end of the barrel.

6. The gas-operated firearm of claim 5 wherein the gas aperture is rearward of the forward majority of the length of the barrel.

7. The gas-operated firearm of claim 1 wherein the gas operating system includes a piston.

8. The gas-operated firearm of claim 1 wherein the gas operating system is free of contact with the barrel.

9. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture; and including an attachment facility securing the rear end of the barrel to the frame and wherein the gas aperture is proximate the attachment facility.

10. A gas-operated firearm comprising:

a frame;

a barrel defining a bore having a forward muzzle end and an opposed rear end defining a chamber;

a bolt assembly received in the frame and operable to reciprocate between a battery position and a recoil position;

the barrel defining a gas aperture communicating with the bore;

a gas operating system connected to the frame, having a gas inlet, and operably connected to the bolt assembly to move the bolt assembly from the battery position toward the recoil position;

the gas inlet being forward of the gas aperture; and wherein the frame contacts the barrel only at the rear end of the barrel, and wherein the gas aperture is defined in the rear end of the barrel.

11. The gas-operated firearm of claim 1 wherein the barrel has a rear end having a cylindrical profile, and wherein the gas aperture is defined in the rear end cylindrical profile.

12. The gas-operated firearm of claim 11 wherein the rear portions end is the largest diameter portion of the barrel.

13. The gas-operated firearm of claim 1 wherein the gas operating system includes a chamber extending rearward from the gas inlet and containing a piston having a forward face facing the gas inlet.

14. The gas-operated firearm of claim 1 wherein the gas conduit is enclosed except for communication with the gas aperture and gas conduit.

15. The gas-operated firearm of claim 1 wherein the gas aperture and gas inlet are in direct communication with the gas conduit.

16. The gas-operated firearm of claim 1 wherein the gas operating system includes a piston having a forward face facing the gas inlet.

17. The gas-operated firearm of claim 1 wherein the gas conduit is free of openings except at the gas inlet and gas aperture.

18. The gas-operated firearm of claim 1 wherein the gas aperture, gas conduit, gas inlet, and gas operating system collectively define a gas path from the barrel, extending forward through the gas conduit, and extending rearward to act upon a gas piston.

* * * * *